US010532488B2

(12) United States Patent
Pegg

(10) Patent No.: US 10,532,488 B2
(45) Date of Patent: Jan. 14, 2020

(54) METHOD AND MOLD FOR RETAINING WALL CORNER AND COLUMN BLOCKS

(71) Applicant: Western Interlock, Inc., Rickreall, OR (US)

(72) Inventor: Wyatt Pegg, Rickreall, OR (US)

(73) Assignee: Western Interlock, Inc., Rickreall, OR (US)

( * ) Notice: Subject to any disclaimer, the term of this patent is extended or adjusted under 35 U.S.C. 154(b) by 0 days.

(21) Appl. No.: 15/902,783

(22) Filed: Feb. 22, 2018

(65) Prior Publication Data

US 2019/0255734 A1 Aug. 22, 2019

(51) Int. Cl.

| | |
|---|---|
| ***E02D 29/02*** | (2006.01) |
| ***B28B 7/18*** | (2006.01) |
| ***B28B 7/24*** | (2006.01) |
| ***B28B 7/10*** | (2006.01) |

(52) U.S. Cl.

CPC ..... *B28B 7/183* (2013.01); *B28B 7/10* (2013.01); *B28B 7/24* (2013.01); *E02D 29/0266* (2013.01); *E02D 29/025* (2013.01)

(58) Field of Classification Search

CPC ..... E02D 29/025; E02D 29/0266
USPC ..... 405/284, 286
See application file for complete search history.

(56) References Cited

U.S. PATENT DOCUMENTS 5,622,456 A 4/1997 Risi et al.
5,984,589 A * 11/1999 Ciccarello ..... E02D 29/0266 405/262
6,149,352 A * 11/2000 MacDonald ..... E02D 29/0266 405/284
6,178,715 B1 1/2001 Pacitto et al.
6,398,458 B1 6/2002 Pacitto et al.
6,431,798 B1 * 8/2002 Magliocco ..... E02D 29/025 405/284
6,829,867 B2 12/2004 Gresser et al.
7,360,970 B2 4/2008 Woolford et al.
7,654,776 B2 * 2/2010 MacDonald ..... E02D 29/0225 405/284
7,963,727 B1 6/2011 Wauhop
8,684,633 B2 4/2014 Rainey
8,882,398 B2 11/2014 Bender et al.
2003/0009970 A1 * 1/2003 MacDonald ..... E02D 29/0241 52/562
2003/0074856 A1 * 4/2003 Hammer ..... E02D 29/025 52/604

(Continued)

FOREIGN PATENT DOCUMENTS

AU 200027651 B2 11/2000
AU 200191446 B2 5/2002

(Continued)

*Primary Examiner* — Frederick L Lagman
(74) *Attorney, Agent, or Firm* — McKee, Voorhees & Sease, PLC

(57) ABSTRACT

A method and mold assembly for forming a dry cast concrete corner blocks having non-parallel front and rear faces and non-parallel end faces, with a hollow central core in the blocks. The corner blocks can be used to build a square or irregular corner in a retaining wall, and can be used to build columns or pillars in the wall, without having to cut the corner blocks. Fill material may be poured into aligned cores in the stacked corner blocks which form the wall corner or column, to stabilize the corner blocks.

16 Claims, 13 Drawing Sheets

(56) References Cited

U.S. PATENT DOCUMENTS

| | | | | |
|---|---|---|---|---|
| 2004/0098938 | A1* | 5/2004 | Nordstrand | E02D 29/025 52/316 |
| 2005/0055944 | A1* | 3/2005 | Hampton | E02D 29/025 52/596 |
| 2006/0051166 | A1 | 3/2006 | Lee | |
| 2008/0159815 | A1* | 7/2008 | Manthei | E02D 29/025 405/286 |
| 2009/0103987 | A1* | 4/2009 | MacDonald | B28B 7/0041 405/284 |
| 2010/0263310 | A1* | 10/2010 | Wauhop | B28B 17/0018 52/250 |
| 2011/0217127 | A1* | 9/2011 | MacDonald | E02D 29/025 405/284 |
| 2013/0067845 | A1* | 3/2013 | MacDonald | E04C 1/395 52/563 |
| 2015/0197912 | A1 | 7/2015 | Parsons | |
| 2016/0244936 | A1* | 8/2016 | MacDonald | B28B 7/0041 |
| 2016/0369472 | A1 | 12/2016 | Ianello et al. | |
| 2017/0260743 | A1* | 9/2017 | Simonson | E02D 29/0266 |

FOREIGN PATENT DOCUMENTS

| | | | |
|---|---|---|---|
| AU | 2003241633 | A1 | 9/2003 |
| AU | 2006249237 | A1 | 6/2007 |
| CA | 2700908 | C | 4/2009 |
| CA | 2854940 | C | 12/2014 |
| EP | 1600563 | A3 | 5/2009 |
| KR | 20060026098 | A | 3/2006 |

* cited by examiner

METHOD AND MOLD FOR RETAINING WALL CORNER AND COLUMN BLOCKS

FIELD OF THE INVENTION

A mold assembly is provided for forming non-rectangular, left and right corner blocks for constructing corners, columns, and pillars in a retaining wall. Opposing faces of the corner block are not parallel to one another, thereby permitting non-square corners to be formed in the wall without cutting the corner blocks.

BACKGROUND OF THE INVENTION

Concrete blocks are often used to build retaining walls of various sizes and shapes. The walls often have corners and/or columns. Conventional blocks used for the corners and columns are square or rectangular, and often require cutting so that adjacent blocks can fit together to form the corner or the column. Such cutting adds time and cost to the construction of the wall. Also, some corner blocks used in wall construction are solid, and thus heavy. The solid blocks also prevent adjacent layers or tiers from being tied together by aggragate fill. Furthermore, the square rectangular blocks are difficult to form into irregular, non-perpendicular angles without cutting the block.

Therefore, there is a need in the industry for an improved corner block, corner block mold, and method of constructing corners and columns in a retaining wall.

Accordingly, a primary objective of the present invention is a provision of a method and mold for forming dry cast concrete corner blocks for use in building corners and columns or pillars in retaining walls.

Another objective of the present invention is the provision of a mold for creating a corner block with non-parallel front and rear surfaces and non-parallel end surfaces for use in a retaining wall.

A further objective of the present invention is a provision of a method for building a retaining wall corner or column using corner blocks having at least one corner which is not square.

Still another objective of the present invention is a provision of a dry cast concrete corner block for use in constructing corners and columns in a retaining wall.

These and other objectives have become apparent from the following description of the invention.

SUMMARY OF THE INVENTION

A mold for forming dry cast concrete corner blocks used in building a retaining wall corner or column comprises four faces, with opposing faces being non-parallel to one another, and at least two adjacent faces being non-perpendicular to one another, so as to yield a non-rectangular corner block. The mold forms a plurality of corner blocks simultaneously, and with a hollow core in each block. The corner blocks are formed in left and right mirror image pairs which can then be used for the wall corners or columns, which can be built with irregular, non-square angles. In the molding process, after the concrete has cured to form each corner block, the mold is raised while the tamper head remains stationery such that the block is ejected out of the bottom of the mold onto a base plate or pallet or floor.

DETAILED DESCRIPTION OF THE DRAWINGS

Figure 1:
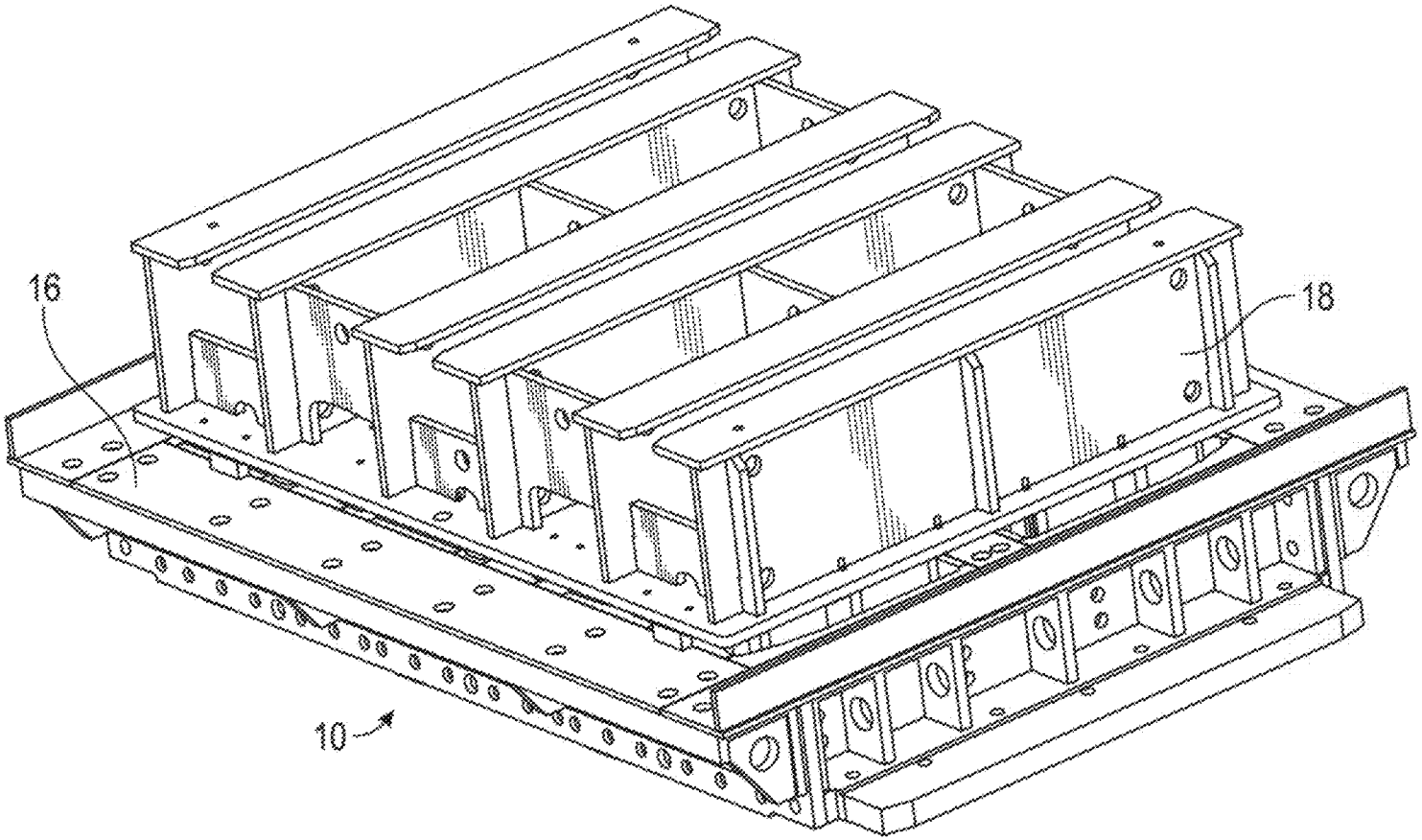
FIG. 1 is a perspective view of the corner block mold assembly according to the present invention.
Figure 2:
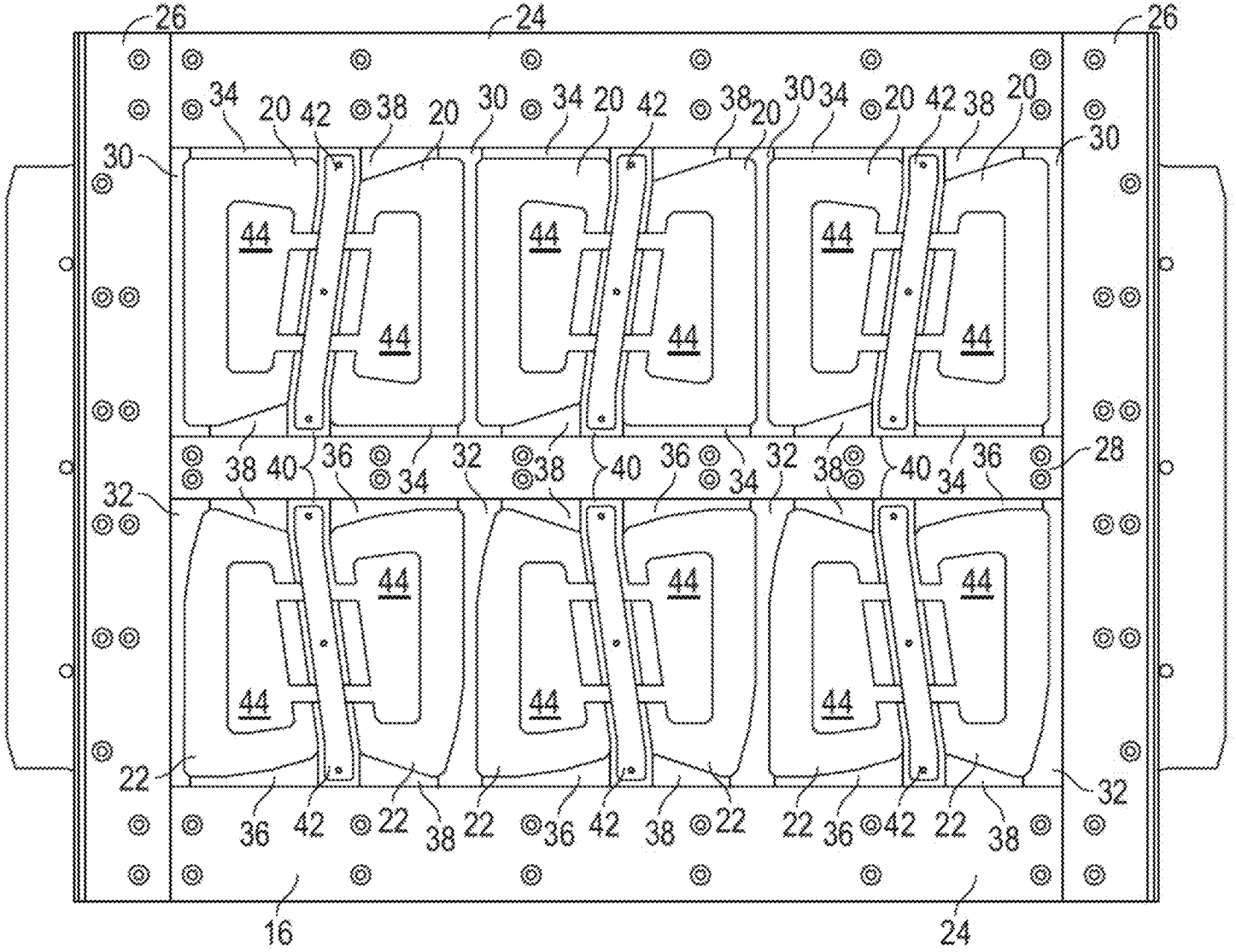
FIG. 2 is a top plan view of the mold assembly.
Figure 3:
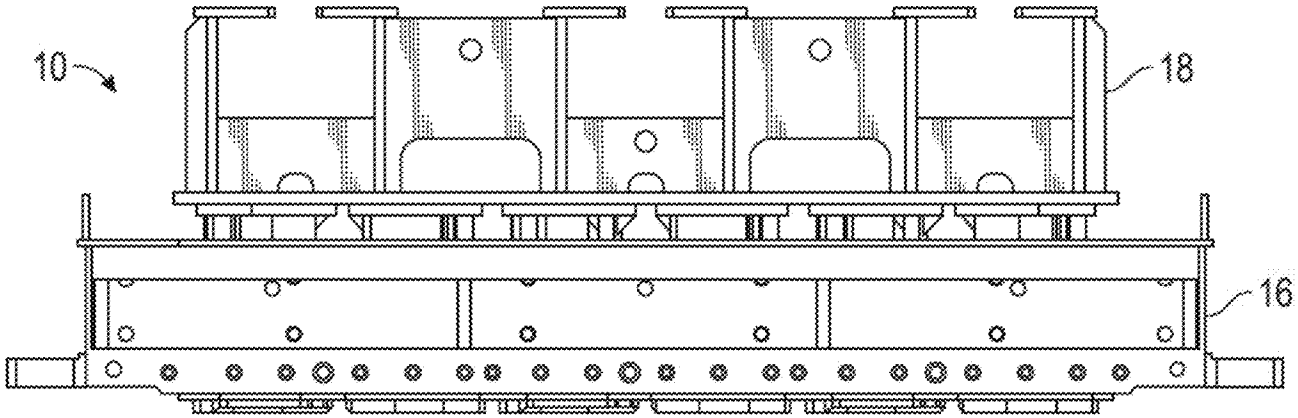
FIG. 3 is a side elevation view of the mold assembly.
Figure 4:
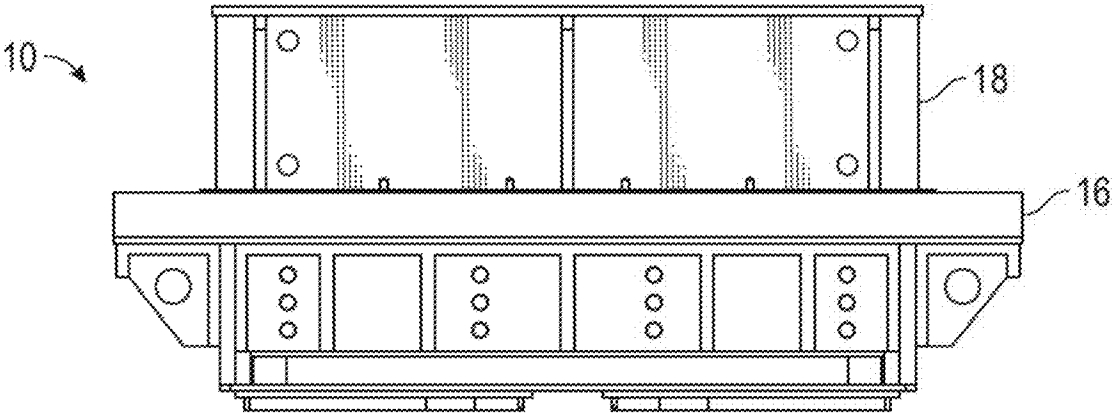
FIG. 4 is an end elevation view of the mold assembly.
Figure 5:
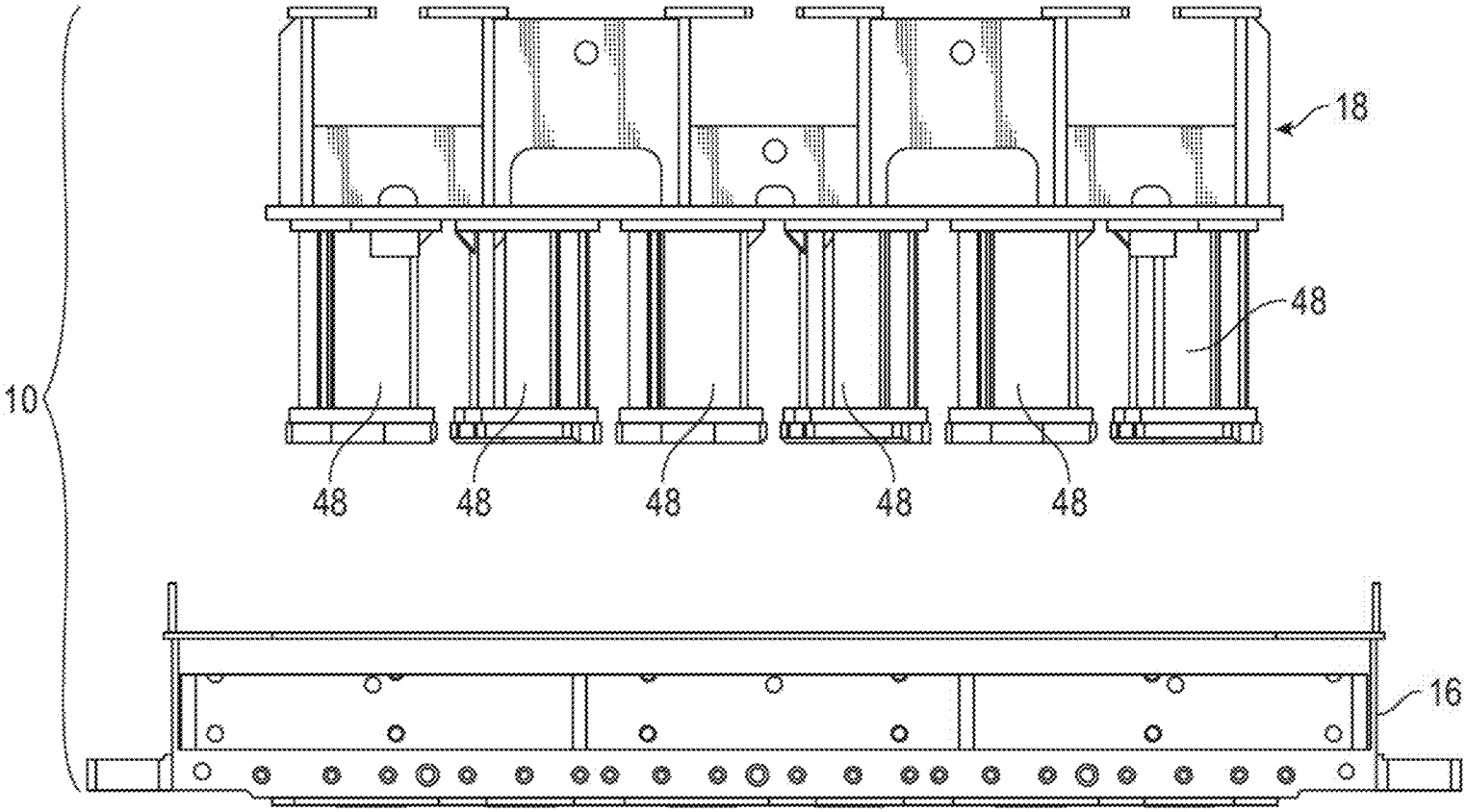
FIG. 5 is a side elevation view of the tamper head.
Figure 6:
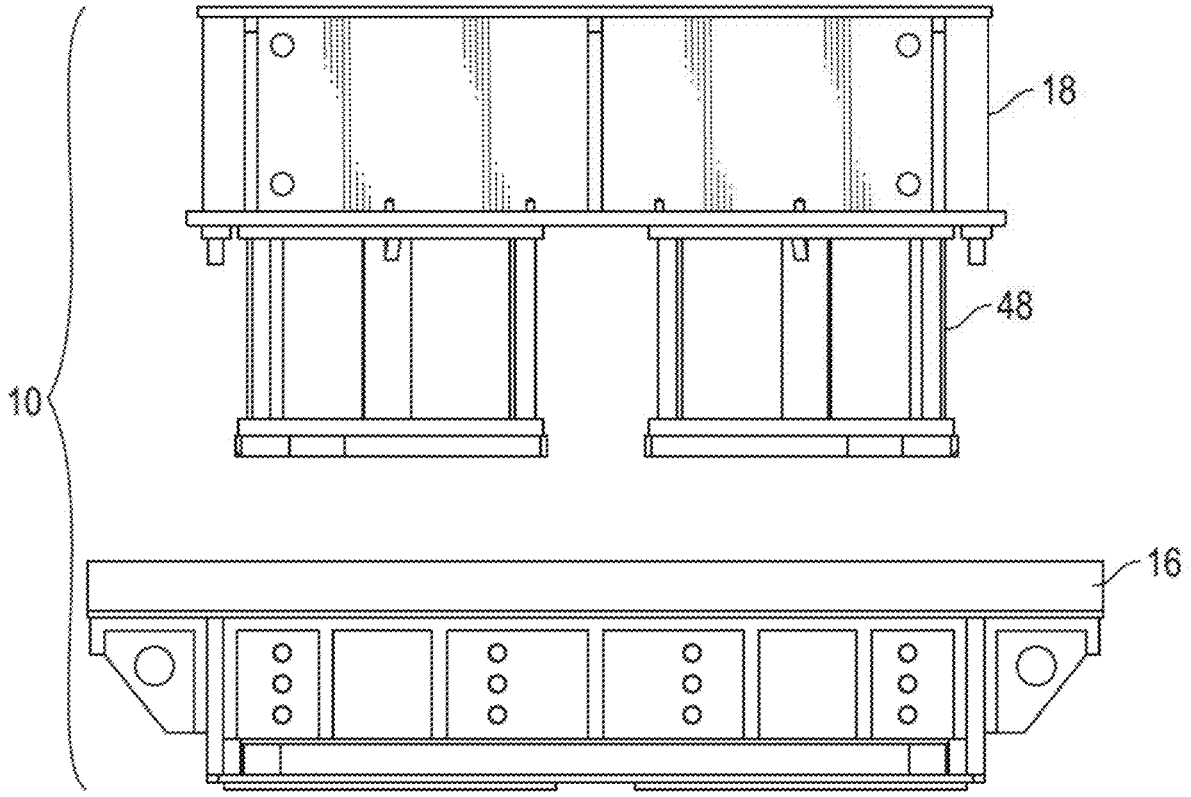
FIG. 6 is a bottom plan view of the tamper head.
Figure 7:
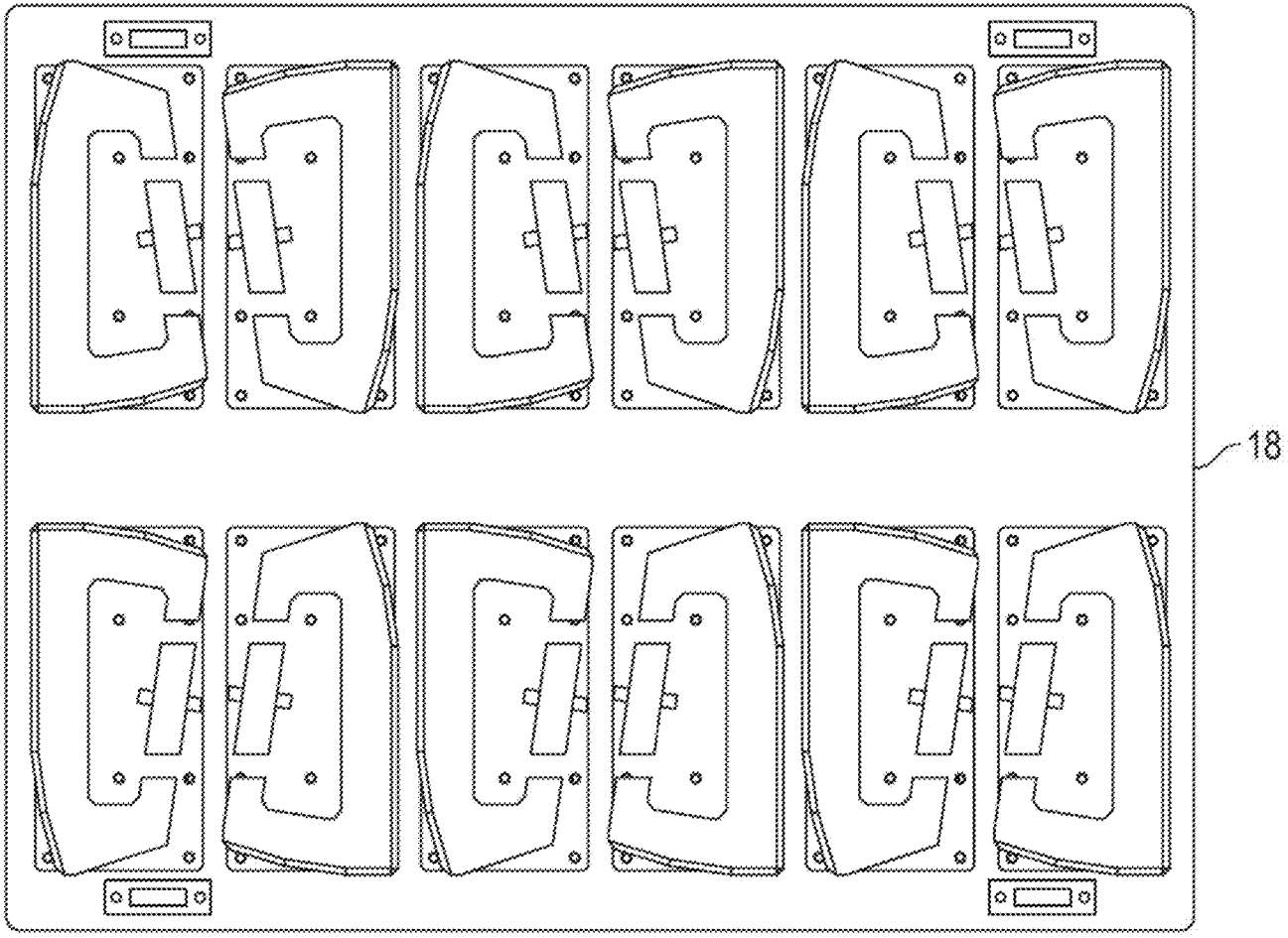
FIG. 7 is an exploded view of the mold and tamper head.
Figure 8:
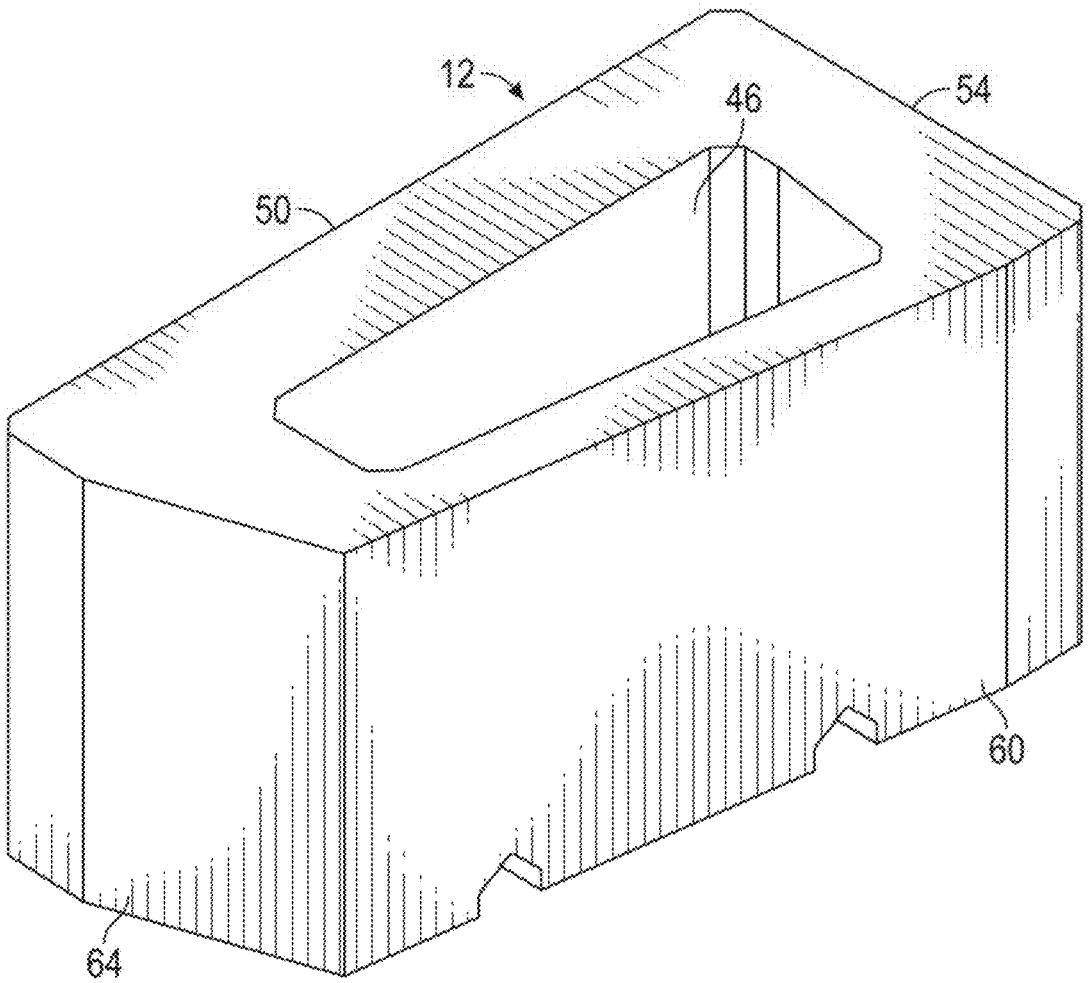
FIG. 8 is a perspective view of a corner block formed by the mold assembly, and having a flat front face.
Figure 8A:
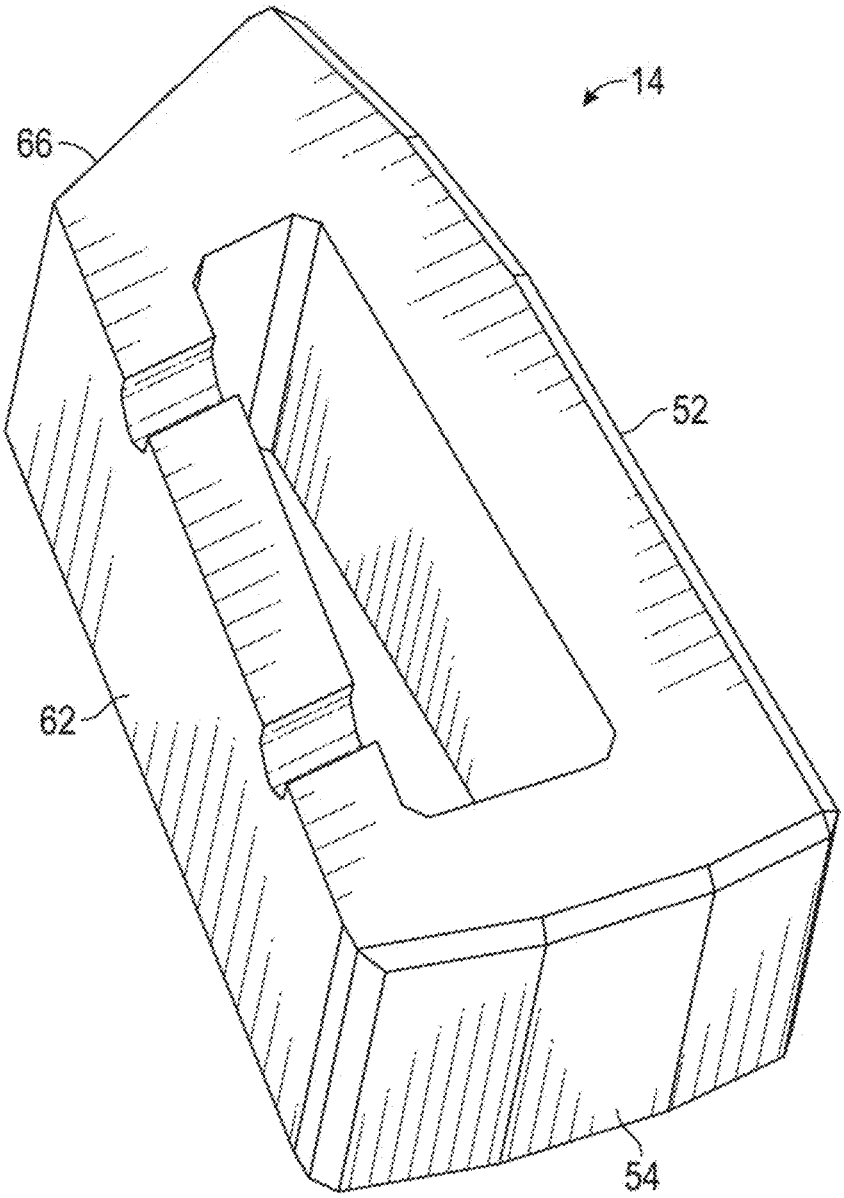
FIG. 8A is a perspective view of a second embodiment for a corner block formed by the mold assembly and having a front face with multiple planes.
Figure 9:
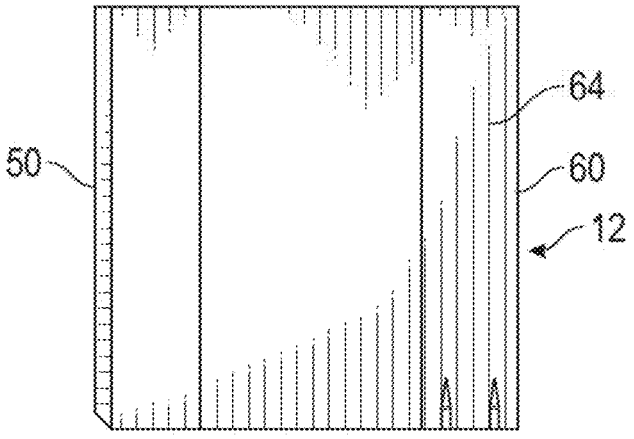
FIG. 9 is an elevation view of one end of the block shown in FIG. 8.
Figure 10:
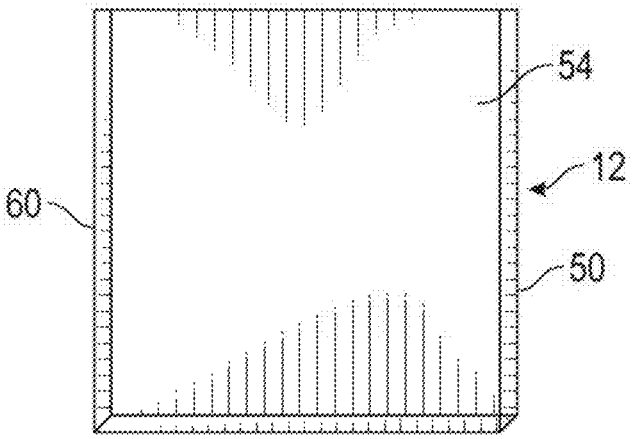
FIG. 10 is an end elevation view of the opposite end of the block, from FIG. 9.
Figure 11:
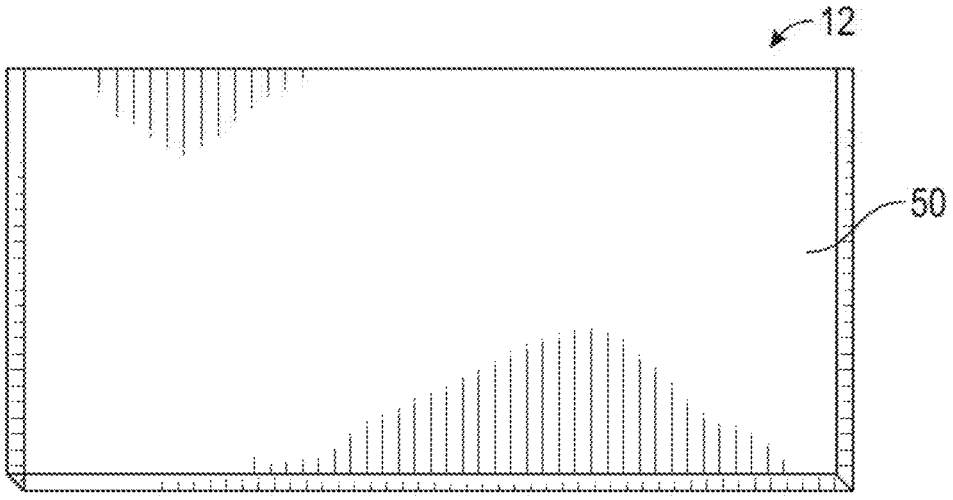
FIG. 11 is a front elevation view of the corner block shown in FIG. 8.
Figure 12:
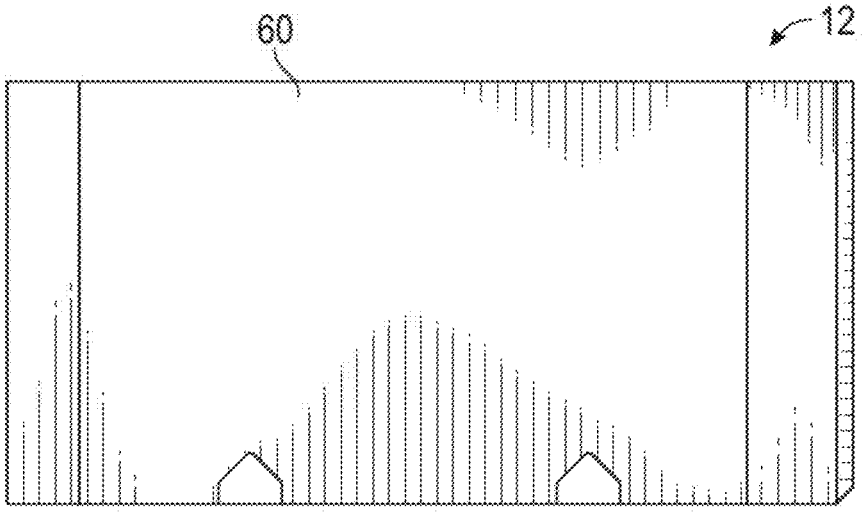
FIG. 12 is a rear elevation view of the corner block shown in FIG. 8.
Figure 14:
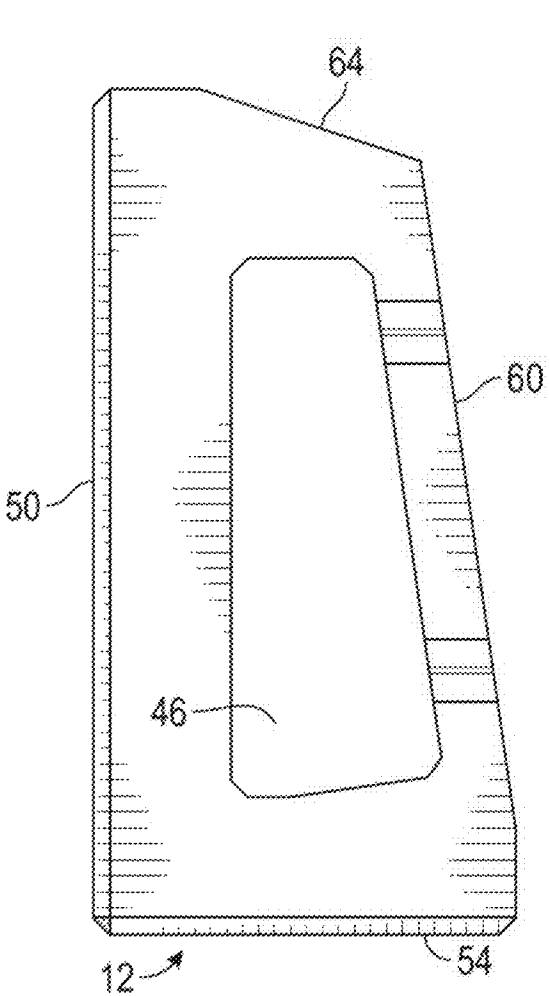
FIG. 14 is a bottom plan view of the corner block shown in FIG. 8.
Figure 13A:
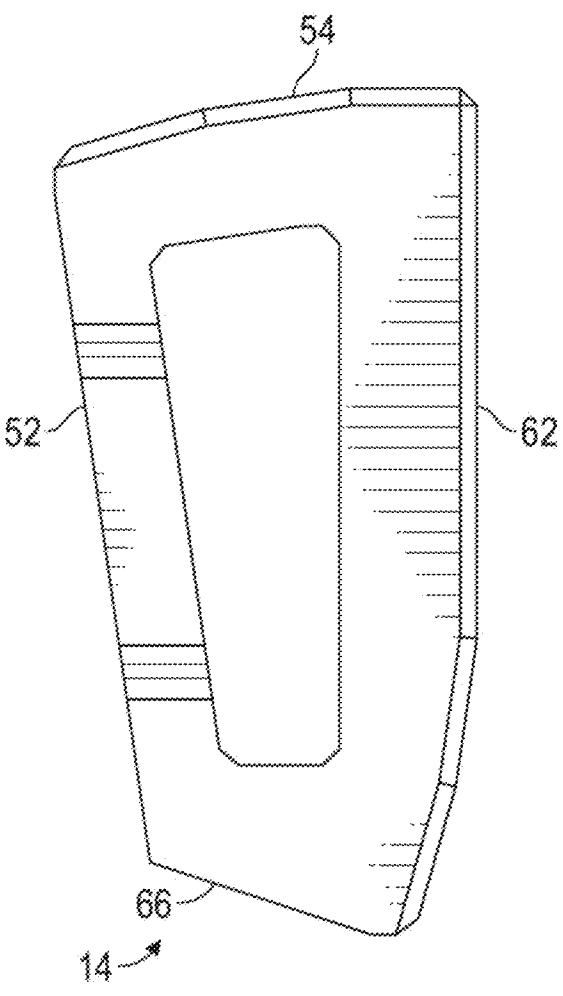
FIG. 13A is a top plan view of an alternative corner block having a multiple plane front face.
Figure 13:
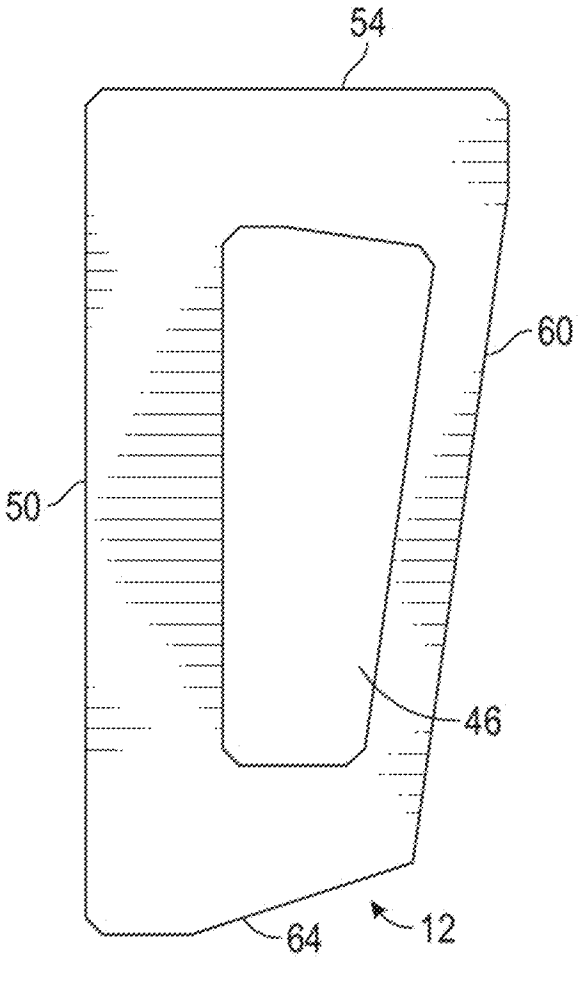
FIG. 13 is a top plan view of the corner block shown in FIG. 8.

The mold assembly of the present invention is generally designated by the reference numeral 10, and is designed to form dry cast concrete corner blocks 12 and 14. The primary difference between the blocks 12, 14 is the front face of each block. Block 12 has a flat front face, while block 14 has a multi-planar front face.

The mold assembly generally includes a mold box 16 and a tamper head 18. The mold box 16 has four walls which form an open top and an open bottom. The box 16 has internal structural components which create cavities 20, 22 for forming the blocks 12, 14. The box 16 includes side deck plates 24 and end deck plates 26. A center bar or deck plate 28 extends between the end deck plates 26, and substantially flush with the upper surfaces of the deck plates 24, 26.

A plurality of shoe molds 30, 32, 34, and 36 are mounted in the box 16. The shoe molds 30 being a single plane flat surface for the blocks 12, while the show molds 32 provide a multi-plane front surface for the box 14. The shoe molds 34 provide a single plane surface for one end of a block 12, while the shoe molds 36 provide a multi plane surface for one end of the block 14. The end shoe molds 38 are used for the opposite ends of both blocks 12, 14. The mold block 16 also includes an inside web 40 with a web deck plate 42. Collectively, the shoe molds and inside webs form the cavities 20, 22. The cavities 20 are arranged so as to form left and right versions of the block 12, which are mirror images of one another. Similarly, the cavities 22 are configured to form left and right mirror images of the block 14. It is understood that the mold box 16 can be used for making both the blocks 12 and 14, only blocks 12, or only blocks 14, as desired. The shoes 30, 32 can be interchanged with one another as can the shoes 34, 36.

A core plug 44 is provided for each cavity 20, 22 so as to form a hollow, central core 46 in each block 12, 14. If a solid block is desired, the core plugs 44 may be removed.

The tamper head 18 is adapted to compress the concrete in the cavities 22, 24. The tamper head 18 is formed with plurality of legs 48, each having a lower surface configured to fit in close tolerance with the cavities 20, 22.

The mold process begins by determining which blocks 12, 14 are desired, and then installing the appropriate shoes 30-38 in the mold box 16, along with the inside webs 40. Once the mold box 16 is fully assembled, the box is positioned on a pallet or plate (not shown) or on a smooth floor so that the dry cast concrete can be introduced into the cavities 20, 22 of the mold box 16. Then, the tamper head 18 is lowered into contact with the concrete to compact the concrete in the cavities 20, 22. Preferably, the tamper head 18 is vibrated during the compaction time. The base pallet or plate may also be vibrated during compaction, such as by a vibrator positioned beneath the plate or pallet. Once the compaction is complete, the mold box 16 is raised, while the taper head 18 remains stationary so as to push the molded blocks 12, 14 out of the open bottom of the box. The base plate or pallet with the blocks 12, 14 thereon can be moved and replaced with an empty base plate or pallet, so that the molding process can be repeated for a new set of blocks.

If desired, the molded blocks 12, 14 can be tumbled to roughen the block, and particularly the front face to provide a more textured appearance to the front walls 50, 52 and end walls 54, 56 of the blocks 12, 14, respectively.

While the drawings show the mold assembly 10 as having 12 cavities 20, 22, it is understood that more or less cavities may be provided in the mold assembly 10. Also, the perimeter shape of the cavities 20, 22 can be modified from that shown in the drawings, without departing from the scope of the present invention.

The mold box 16 forms the blocks 12, 14 such that the front faces or walls 50, 52 are not parallel with the rear walls 60, 62. Likewise, the opposite end walls 54, 64 of the block 12 are not parallel to one another, nor are the end walls 56, 66 of the block 14 parallel to one another.

Figure 15:
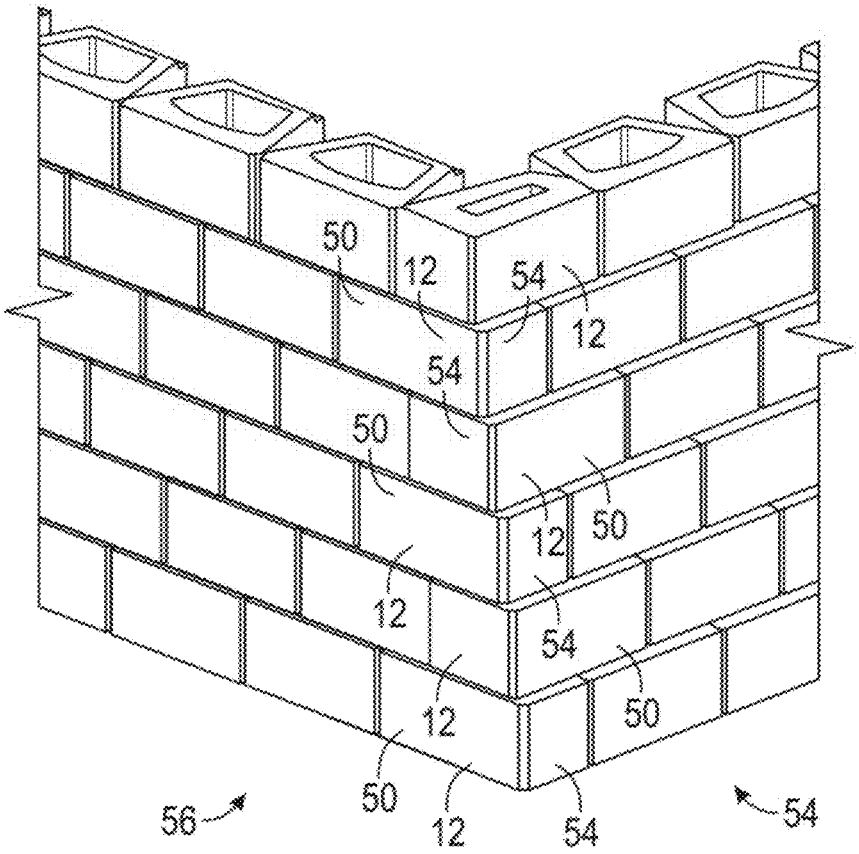
FIG. 15 shows a retaining wall having a corner built with the corner blocks formed by the mold assembly.
Figure 16:
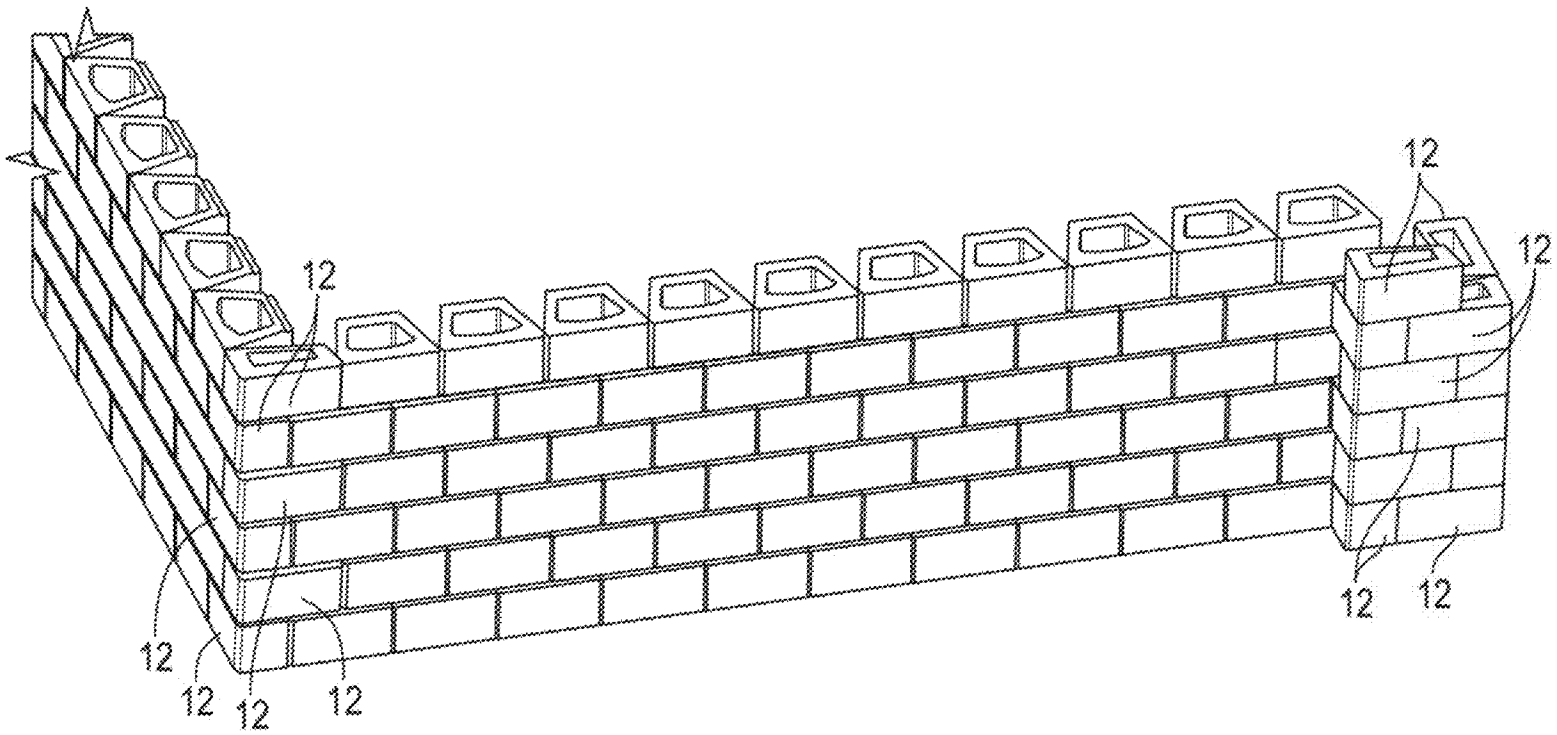
FIG. 16 shows a retaining wall having a column or pillar built with the corner blocks formed by the mold assembly.

Preferably, the front wall or face 50 and end wall 54 of the block 12 are formed perpendicular to one another. This square corner between the walls 50, 54 allows a right-angle corner to be formed in a retaining wall as shown in FIG. 15. Alternatively, an irregular, non-perpendicular corner can be formed in the retaining wall due to the non-square angular relationship between the front faces 50, 52 and the end wall 64, 66. Similarly, column or pillars 70 can be formed in the retaining wall as shown in FIG. 16 using the blocks 12 or 14. The wall corners and columns or pillars can be built without cutting the blocks 12, 14. Furthermore, the hollow cores 46 of the blocks 12, 14 partially overlap one another in the wall corner or column, such that aggregate, gravel, or concrete can be used to fill the aligned cores and thereby stabilize the corner or column.

The dry cast concrete used in molding the blocks 12, 14 may be a single homogenous color, or may comprise multiple colors. Preferably, an initial batch of dry cast concrete is produced in a large planetary mixer, and is then emptied into multiple hoppers beneath the mixer. Each hopper can hold a different color concrete or the same color concrete. The concrete from each hopper is then introduced into a production machine hopper using a concrete feeding belt. Color blends may be created by layering the different color concrete from multiple hoppers into the production machine hopper using timers for the multiple hoppers beneath the mixer. The concrete is then transferred from the production machine hopper into a movable feeding box beneath the production machine hopper. The feed box then can be moved over the mold assembly 10 so that the single or multi-colored concrete is filled into the mold cavities 20, 22, as described above.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A molded concrete corner block for use in building a retaining wall, comprising:
- a front first face;
- an end second face;
- a rear third face;
- an end fourth face;
- the first and second faces being perpendicular to one another for forming a square corner in the retaining wall;
- the third and fourth faces being non-perpendicular to one another;
- the first and third faces being non-parallel to one another;
- the second and fourth faces being non-parallel to one another; and
- whereby the four faces form only a single square vertical corner on the block.

2. The corner block of claim 1 wherein the first face is substantially a single plane.

3. The corner block of claim 2 wherein the second face is substantially a single plane.

4. The corner block of claim 2 wherein the front face has multiple planes.

5. The corner block of claim 1 wherein the fourth face is angled inwardly relative to the first face.

6. The corner block of claim 1 wherein the third face is angled inwardly relative to the second face.

7. The corner block of claim 1 wherein the first and second faces are roughened by tumbling the block.

8. The corner block of claim 1 further comprising at least three colors in the first and second faces.

9. The corner block of claim 1 wherein the block is formed by a dry cast process.

10. A retaining wall block, comprising:
- a front face, a rear face, and opposite end faces;
- the front face and one of the end faces form a vertical square corner for the block;
- wherein the rear face is not perpendicular to either end face; and
- wherein the block has only one vertical square corner.

11. The retaining wall block of claim 10 wherein the front face is perpendicular to one of the end faces.

12. The retaining wall block of claim 10 wherein none of the faces being parallel to one another.

13. The retaining wall block of claim 10 wherein the block is formed by dry casting.

14. The retaining wall block of claim 10 wherein the front face has at least three colors.

15. The retaining wall block of claim 10 wherein the front face is a single plane.

16. The retaining wall block of claim 10 wherein the front face has multiple planes.

* * * * *